United States Patent [19]

Hartley

[11] 4,396,357

[45] Aug. 2, 1983

[54] DIAPHRAGM PUMP WITH BALL BEARING DRIVE

[75] Inventor: E. Dale Hartley, Malibu, Calif.

[73] Assignee: Product Research and Development, Anaheim, Calif.

[21] Appl. No.: 251,343

[22] Filed: Apr. 6, 1981

[51] Int. Cl.[3] ..... F04B 1/18; F16H 23/04

[52] U.S. Cl. ..... 417/269; 74/60

[58] Field of Search ..... 417/269, 271; 74/60

[56] References Cited

U.S. PATENT DOCUMENTS

| | | | |
|---|---|---|---|
| 2,797,647 | 7/1957 | Floraday | 417/269 |
| 3,199,531 | 8/1965 | Cornelius | 417/271 |
| 4,153,391 | 5/1979 | Hartley | 417/271 |

*Primary Examiner*—William L. Freeh

*Attorney, Agent, or Firm*—Gordon L. Peterson

[57] ABSTRACT

A diaphragm pump comprising a supporting structure, a rotatable input member and first and second bearings mounted on the input member so that the rotation of the input member causes the second bearing to nutate. Each of the bearings have outer races, and the outer race of the first bearing is coupled to the supporting structure by a mounting member of sheet material. A region of the diaphragm forms a portion of a pumping chamber, and a drive member is provided for moving the region of the diaphragm in at least one direction. First and second mounting members couple the outer race of the second bearing to the drive member so that nutation of the second bearing causes the pump to operate.

13 Claims, 4 Drawing Figures

DIAPHRAGM PUMP WITH BALL BEARING DRIVE

BACKGROUND OF THE INVENTION

My prior U.S. Pat. No. 4,153,391 discloses a diaphragm pump which is driven by a wobble plate. The wobble plate is mounted for nutating motion by a ball which supports the wobble plate against radial loads. The wobble plate is driven by an input assembly which includes two needle bearings which accommodate the axial loads.

This pump has served very satisfactorily, particularly when used for intermittent duty, such as a water pump for a recreational vehicle. However, for applications where continuous duty is required, the grease for the needle bearings may be thrown out of the needle bearings, and when this occurs, the needle bearings tend to overheat and rust. Ball bearings can be used to drive the wobble plate of a diaphragm pump as shown, for example, by Zubaty U.S. Pat. No. 2,991,723. However, this patented construction employs a relatively heavy wobble plate on one of the ball bearings and a sliding shoe for driving the diaphragm in only one direction. A spring must be located in the pumping chamber, and hence in the fluid being pumped, for driving the diaphragm in the other direction.

SUMMARY OF THE INVENTION

This invention overcomes these disadvantages by using relatively lightweight and inexpensive mounting members of sheet material for mounting the ball bearings of the drive mechanism. This facilitates assembly, reduces the cost of the ball bearing drive and reduces or eliminates dynamic balancing problems that exist with heavy wobble plates.

A drive mechanism constructed in accordance with the teachings of this invention may include a rotatable input member having first and second bearing mounting surfaces with the axes of the bearing mounting surfaces being inclined relative to each other and first and second bearings having inner and outer races. The first and second bearing mounting surfaces receive the inner races of the first and second bearings, respectively.

The outer race of the first bearing is easily and inexpensively coupled to the supporting structure of the pump by a mounting member of sheet material. Accordingly, rotation of the input member causes the second bearing to nutate.

The drive mechanism can be used to drive different kinds of devices, such as pumps, compressors, vibrating elements, and various drive members. The drive mechanism is particularly adapted to drive pumps, such as diaphragm and piston pumps. For example, a diaphragm can be mounted on the supporting structure to define portions of one or more pumping chambers. A driving member drives the first region of the diaphragm in at least one direction.

The second bearing is easily and inexpensively coupled to the driving member by first and second mounting members of sheet material. The first mounting member has an opening therein for receiving at least a portion of the driving member. Fastener means couple the second mounting member to the driving member, and the second mounting member retains the first mounting member on the driving member. In addition, the fastener means holds the mounting members together so that the outer race of the second bearing is clamped between them. With this construction, the first and second mounting members form, in effect, a wobble plate driven by the second bearing, and the wobble plate is securely coupled to the second bearing and the drive member so that it can produce a pumping action.

Preferably, the driving member has a supporting surface, and at least a portion of the first mounting member is clamped between the supporting surface and the second mounting member. The fastener means can advantageously include a threaded fastener, and by making such portion of the driving member and the opening non-circular, the threaded fastener can be tightened, and the first mounting member will hold the driving member against rotation.

According to a preferred construction, the second mounting member may include a generally shallow cup having an open end, and the second bearing is received in the cup. The first mounting member may include a generally flat plate at least partially covering the open end of the cup. With this construction, the mounting members at least partially house the second bearing.

The first and second mounting members may be similarly coupled to driving members associated with each of the pumping chambers. For example, if three pumping chambers are employed, the first and second mounting members may be triangular and coupled, respectively, at the apices of the triangle to the three driving members of the three pumping chambers.

The invention, together with further features and advantages thereof, may best be understood by reference to the following description taken in connection with the accompanying illustrative drawings.

DESCRIPTION OF THE PREFERRED EMBODIMENT

Figure 1:
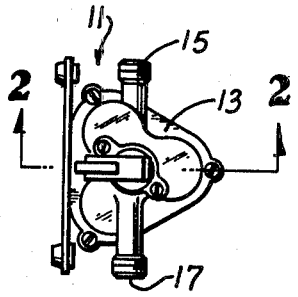
FIG. 1 is an end elevational view of a pump constructed in accordance with the teachings of this invention.
Figure 2:
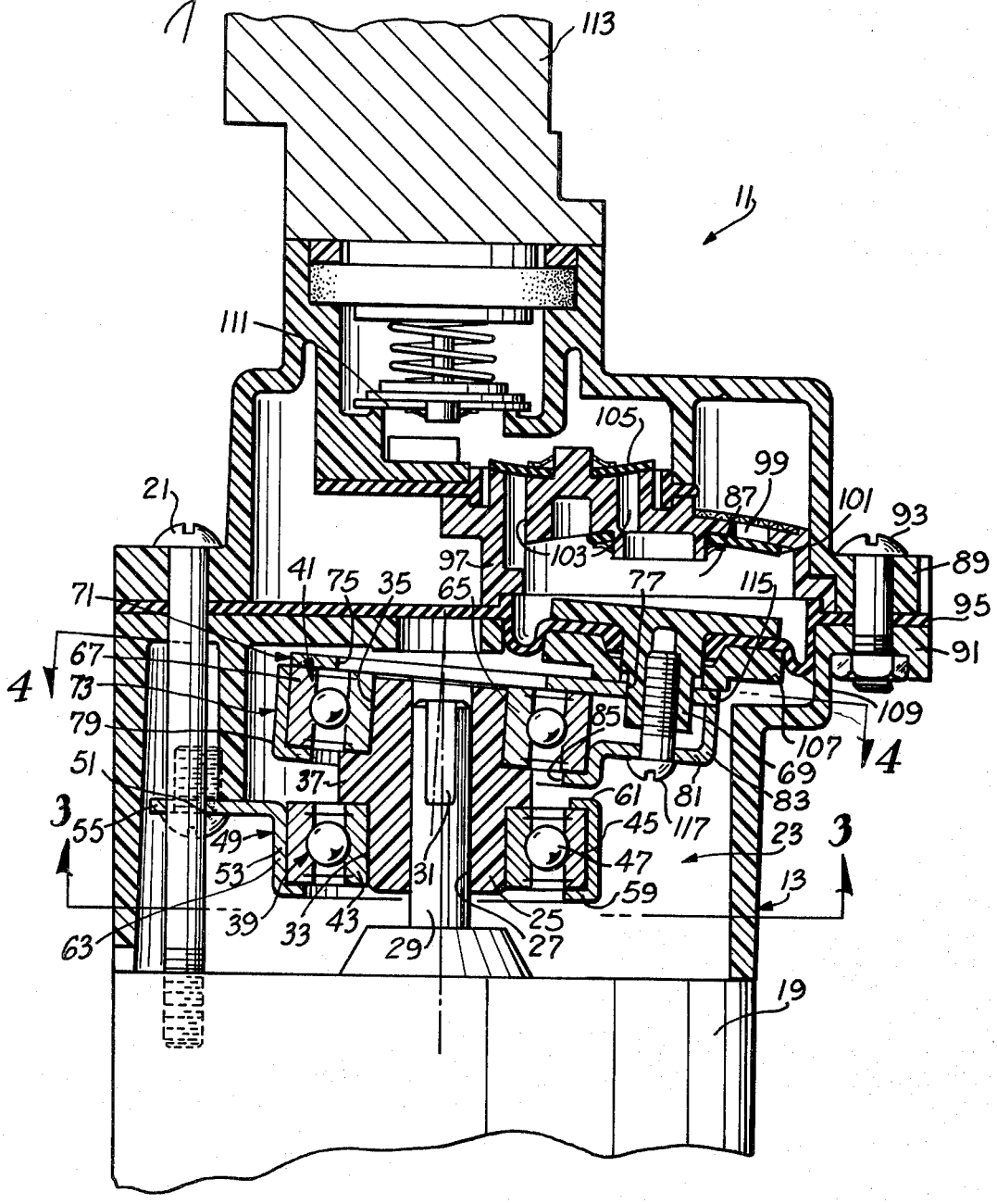
FIG. 2 is a sectional view taken generally along line 2—2 of FIG. 1.
Figure 3:
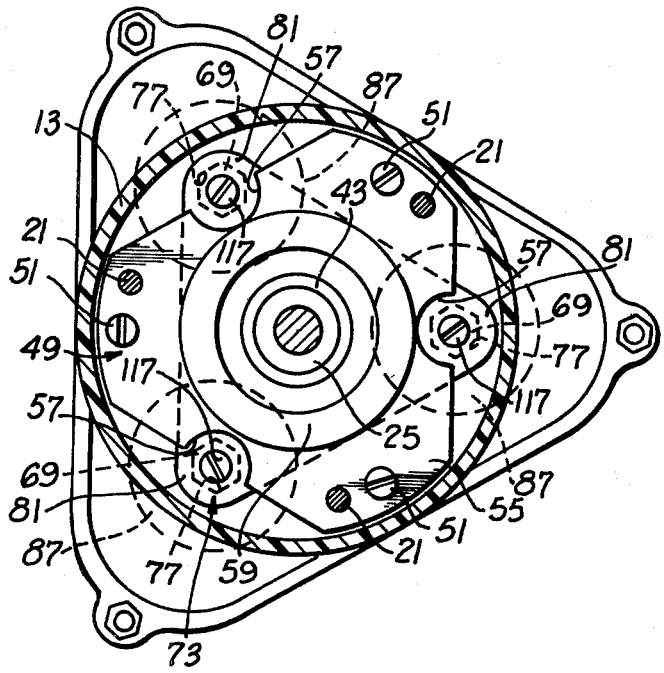
FIG. 3 is a sectional view taken generally along line 3—3 of FIG. 2.

FIGS. 1–3 show a pump 11 constructed in accordance with the teachings of this invention. The pump 11 includes a supporting structure which includes a housing 13 having an inlet 15 (FIG. 1) and an outlet 17. A motor 19 (FIG. 2) is attached to the housing 13 by threaded fasteners 21. The motor 19 drives the pump via a ball bearing drive mechanism 23.

The drive mechanism 23 includes a rotatable input member in the form of a sleeve 25 having a bore 27 therethrough for receiving a drive shaft 29 of the motor 19. The sleeve 25, which may be constructed of a metal, such as aluminum or a suitable plastic, has a flat portion for cooperating with a flat 31 (FIGS. 2 and 4) on the drive shaft 29 to permit the drive shaft to rotate the sleeve. The sleeve 25 also has cylindrical bearing mounting surfaces 33 and 35 separated axially by an annular flange 37. The bearing mounting surface 33 is coaxial with the bore 27 but the bearing mounting surface 35 is inclined with respect to the axis of the bore 27 and the bearing mounting surface 33.

A supporting bearing 39 and a nutating bearing 41 are mounting on the bearing mounting surfaces 33 and 35, respectively. Each of the bearings 39 and 41 should be a ball bearing. The bearing 39 has an inner race 43 which may be pressed onto the sleeve 25 for rotation therewith, an outer race 45 and a series of balls 47 between the two races.

The outer race 45 is attached to the housing 13 by a mounting member 49 of sheet metal and a plurality of screws 51 (FIGS. 2 and 3). Although the mounting member 49 may be of various different constructions, in the embodiment illustrated, it is integrally constructed from steel and includes a cup-like retainer 53 for receiving the outer race 45 and a radially extending flange 55. The flange 55 has arcuate recesses 57 (FIG. 3) to provide room for the passage of the fasteners 117. The outer race 45 is gripped by an annular flange 59 of the retainer 53 and tabs 61 (FIG. 2) located at each of the recesses 57. The retainer 53 also includes a peripheral wall 63 for surrounding and encasing the outer periphery of the outer race 45. As shown in FIGS. 2 and 3, the screws 51 project through openings in the flange 55 at three locations to attach mounting member 49 to the housing 13.

The nutating bearing 41 may be identical to the support bearing 39, and, as such, it includes an inner race 65 pressed on the bearing mounting surface 35, an outer race 67 and a series of balls between the two races. Because of the inclination of the bearing mounting surface 35, the bearing 41 is mounted on the sleeve 25 in a plane which is inclined relative to a radial plane. Consequently, rotational movement of the sleeve 25 causes the bearing 41 to nutate.

Figure 4:
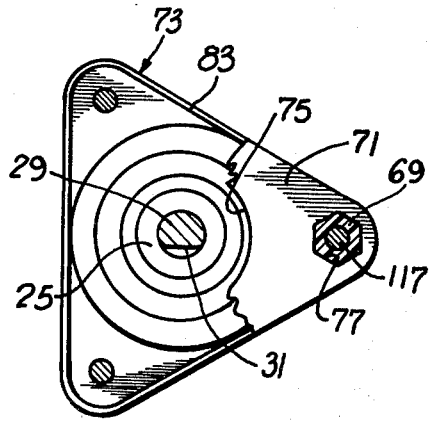
FIG. 4 is a sectional view taken generally along line 4—4 of FIG. 2.

The nutating motion of the bearing 41 can be transmitted to a driving member 69 by a wobble plate which includes bearing mounting members 71 and 73 (FIGS. 2–4). The mounting members 71 and 73 are constructed of sheet material, such as steel, and the mounting member 71 in the embodiment illustrated is in the form of a generally flat triangular plate having a central circular opening 75 and three non-circular openings in the form of hexagonal openings 77 adjacent each apex of the triangle.

The mounting member 73 is generally in the form of a shallow cup which receives the bearing 41. The mounting member 73 includes a dimple 79 for receiving the outer race 67, three generally triangular projections 81 (FIG. 3) and a continuous flange 83 extending completely around the mounting member. The dimple 79 has a central opening 85 so that the inner race 65 is not contacted by the mounting member 73. The mounting member 73 is generally triangular and co-extensive with the triangular configuration of the mounting member 71.

The mounting members 71 and 73 can drivingly couple the nutating bearing 41 to one or more of the driving members 69 which can drive various different devices. However, in the embodiment illustrated, the drive members form a part of a three-chamber diaphragm pump having three pumping chambers 87, and one of the driving members 69 is associated with each of the pumping chambers.

The ball bearing drive mechanism 23 can be used to drive different kinds of pumps, and the pump construction illustrated is merely illustrative. The pumping chambers 87 and the associated pump construction may be identical with the pump disclosed in my U.S. Pat. No. 4,153,391 which is incorporated by reference herein and, for that reason, the pump is not described in detail herein.

Briefly, the housing 13 includes housing sections 89 and 91 held together by a plurality of fasteners 93 and having a diaphragm 95 sandwiched therebetween. Cooperating with a region of the diaphragm 95 to define one of the pumping chambers 87 is a cup-shaped insert 97 (FIG. 2) which has an inlet 99, an inlet check valve 101, an outlet 103 and an outlet check valve 105. A region of the diaphragm 95 is clamped between the drive member 69 and a clamp 107, and an annular fold 109 in the diaphragm allows for some radial displacement of this region of the diaphragm. On the intake stroke, the driving member 69 and the attached region of the diaphragm 95 move downwardly as viewed in FIG. 2 to draw water from the inlet 15 (FIG. 1) through the inlet 99 and into the pumping chamber 87. On the discharge stroke, the driving member 69 and the attached region of the diaphragm 95 move upwardly as viewed in FIG. 2 to force the water in the pumping chamber 87 through the outlet 103, the check valve 105 and a spring-biased outlet valve 111 to the outlet 17 as described more fully in my U.S. Pat. No. 4,153,391. A pressure switch 113 monitors the water pressure downstream of the outlet valve 111 to control the cycling of the motor 19 on and off.

To enable the ball bearing drive mechanism 23 to provide a pumping action for each of the pumping chambers 87, each of the openings 77 in the mounting member 71 receives a portion of one of the driving members 69. Each of the driving members 69 has a supporting surface 115 (FIG. 2) for supporting the mounting member 71. Three screws 117 attach the mounting member 73 at the projections 81, respectively, to each of the driving members 69. The end of the flange 83 bears on the mounting member 71 to clamp the mounting member 71 tightly against the supporting surface 115. In addition, the screws 117 cause the mounting members 71 and 73 to tightly clamp the outer race 67 to thereby provide a sturdy driving connection between the nutating bearing 41 and the driving members 69. This enables the nutating motion of the bearing 41 and the mounting members 71 and 73 to drive each of the driving members through intake and discharge strokes in a predetermined sequence.

The portion of each of the driving members 69 received in the associated opening 77 is non-circular and generally conforms to the non-circular configuration of the opening 77. With this construction, the mounting member 71 holds the driving members 69 against rotation as the screws 117 are tightened.

Preferably, the axis of the bearing mounting surface 35 intersects the axis of the drive shaft 29 and the bearing mounting surface 33 in the plane of the diaphragm 95. This places what might be termed the center of nutation in the plane of the diaphragm with the result that there is substantially no radial movement in the plane of the diaphragm.

Although an exemplary embodiment of the invention has been shown and described, many changes, modifications and substitutions may be made by one having ordinary skill in the art without necessarily departing from the spirit and scope of this invention.

I claim:

1. An apparatus comprising:

a rotatable input member having first and second bearing mounting surfaces, with the axes of the first and second bearing mounting surfaces being inclined relative to each other;

first and second bearings, each of said bearings having an inner race, an outer race and means between said races to provide low friction rotation of one of said races relative to the other of said races;

said first and second bearing mounting surfaces of said rotatable input member being received by said inner races of said first and second bearings, respectively;

a supporting structure;

means for coupling the outer race of said first bearing to the supporting structure whereby rotation of the rotatable input member causes the second bearing to nutate;

first and second mounting members of sheet material on opposite sides of the second bearing;

a driving member;

said first mounting member having an opening therein for receiving at least a portion of said driving member; and fastener means for coupling the second mounting member to the driving member, said second mounting member retaining the first mounting member on the driving member and said fastener means holding the mounting members in clamping relationship with the outer race of the second bearing whereby the second bearing is coupled to the drive member to drive the latter.

2. An apparatus as defined in claim 1 including means defining a pump chamber and means for coupling the driving member to the pumping chamber.

3. An apparatus as defined in claim 1 including a diaphragm mounted on the supporting structure and means cooperating with at least a first region of the diaphragm to define a pumping chamber, said driving member driving the first region of the diaphragm in at least two directions to provide pumping action in the pumping chamber.

4. An apparatus as defined in claim 1 wherein said driving member has a supporting surface and at least a portion of said first mounting member is clamped between said supporting surface and said second mounting member.

5. An apparatus as defined in claim 1 wherein said fastener means includes threaded fastener means and said portion of said driving member and said opening are non-circular whereby the threaded fastener means can be tightened with the first mounting member holding the driving member against rotation.

6. An apparatus as defined in claim 1 wherein the center of nutation is substantially at said diaphragm.

7. An apparatus as defined in claim 1 wherein said second mounting member includes a generally shallow cup having an open end, said outer face of said second bearing being received in said cup, and said first mounting member includes a generally flat plate at least partially covering the open end of the cup whereby the mounting members at least partially house the second bearing.

8. An apparatus as defined in claim 3 wherein said pumping chamber is a first pumping chamber, said diaphragm pump includes means cooperating with a second region of the diaphragm to define a second pumping chamber, a second driving member for driving the second region of the diaphragm in at least one direction to provide a pumping action, said first mounting member having a second opening therein for receiving at least a portion of said second driving member, and second fastener means for coupling the second mounting member to the second driving member.

9. An apparatus as defined in claim 1 wherein said coupling means includes a third mounting member of sheet material coupled to the outer race of said first bearing, said third mounting member including a flange, and means for coupling said flange to said supporting structure.

10. A pump comprising:

a rotatable input member having a bearing mounting surface;

means for mounting the rotatable input member for rotation about a rotational axis with the axis of the bearing mounting surface being inclined relative to the rotational axis;

a bearing having an inner race, an outer race and means between said races to provide low friction rotation of one of said races relative to the other of said races;

said bearing mounting surface of said rotatable input member being received by said inner race of said bearing;

first and second mounting members of sheet material on opposite sides of the bearing;

a driving member movable along a path to pump fluid;

said first mounting member having an opening therein for receiving at least a portion of said driving member; and fastener means for coupling the second mounting member to the driving member, said second mounting member retaining the first mounting member on the driving member and said fastener means holding the mounting members in clamping relationship with the outer race of the bearing whereby the bearing is coupled to the drive member to drive the latter along said path.

11. A pump as defined in claim 10 wherein said driving member has a supporting surface and at least a portion of said first mounting member is clamped between said supporting surface and said second mounting member.

12. An apparatus as defined in claim 10 wherein said fastener means includes threaded fastener means and said portion of said driving member and said opening are non-circular whereby the threaded fastener means can be tightened with the first mounting member holding the driving member against rotation.

13. An apparatus as defined in claim 10 wherein said second mounting member includes a generally shallow cup having an open end, said outer race of said bearing being received in said cup, and said first mounting member includes a generally flat plate at least partially covering the open end of the cup whereby the mounting members at least partially house the bearing.

* * * * *